US005761805A

United States Patent [19]

Guyer

[11] Patent Number: 5,761,805

[45] Date of Patent: Jun. 9, 1998

[54] METHOD OF MAKING A HIGH DENSITY ELECTRICAL CONNECTOR

[75] Inventor: Kenneth Wayne Guyer, Thompsontown, Pa.

[73] Assignee: The Whitaker Corporation, Wilmington, Del.

[21] Appl. No.: 623,030

[22] Filed: Mar. 28, 1996

[51] Int. Cl.[6] ..... H01R 43/00

[52] U.S. Cl. ..... 29/883

[58] Field of Search ..... 29/874, 883, 884; 264/272.11, 272.12, 272.15, 272.17, 272.14; 439/405

[56] References Cited

U.S. PATENT DOCUMENTS

| | | | |
|---|---|---|---|
| 3,760,335 | 9/1973 | Roberts | 339/99 R |
| 4,035,050 | 7/1977 | Volinskie | 339/99 R |
| 4,147,399 | 4/1979 | Moser et al. | 339/99 R |
| 4,781,615 | 11/1988 | Davis et al. | 439/395 |
| 4,875,877 | 10/1989 | Fleak et al. | 439/497 |
| 4,917,629 | 4/1990 | Matsuzaki et al. | 439/405 |
| 5,030,138 | 7/1991 | Capp et al. | 439/497 |
| 5,074,039 | 12/1991 | Hillbish et al. | 29/883 |
| 5,108,317 | 4/1992 | Beinhaur et al. | 439/736 |
| 5,129,840 | 7/1992 | Kuzuno et al. | 439/397 |
| 5,201,883 | 4/1993 | Atoh et al. | 29/883 |
| 5,214,846 | 6/1993 | Asami et al. | 29/827 |
| 5,421,747 | 6/1995 | Agnihotri et al. | 439/736 |
| 5,520,550 | 5/1996 | Okabe | 439/404 |
| 5,536,182 | 7/1996 | Atoh et al. | 439/404 |

OTHER PUBLICATIONS

U.S. Patent Application Serial No. 08/453,128 filed May 24,1995 (Abstract and Drawings only included).

*Primary Examiner*—Carl E. Hall
*Assistant Examiner*—Christopher Goins
*Attorney, Agent, or Firm*—Anton P. Ness

[57] ABSTRACT

Electrical connector (10) having a housing (12) molded around body sections of a plurality of terminals (40,42,44, 46) disposed in first and second rows. The terminals have IDC termination sections (32,34,36,38) for respective wires (22,24) to be urged thereinto by termination covers (26,28). All IDC termination sections extend in a common direction from a common side of housing (12), and those (32,34) of the first row are staggered rearwardly from those (36,38) of the second row to facilitate wire insertion. The molding method includes providing core pins (92,94) for supporting the terminals from one (74) of the mold halves, and lower terminals (40,42) include lateral offsets (134) permitting core pins (94) to pass thereby to reach upper terminals (44,46) vertically aligned therewith.

4 Claims, 8 Drawing Sheets

METHOD OF MAKING A HIGH DENSITY ELECTRICAL CONNECTOR

FIELD OF THE INVENTION

The present invention relates to the field of electrical connectors and more particularly to high density connectors having a housing molded around rows of terminals.

BACKGROUND OF THE INVENTION

There are connectors known in which a plurality of terminals are disposed in rows of respective passageways of an insulative housing, with contact sections exposed along a mating face of the connector, and the terminals are terminated to respective conductors at termination sections along a rear face of the housing. One such connector is disclosed in U.S. Pat. No. 3,760,335 wherein the terminals are inserted into the respective passageways prior to being terminated to respective conductors, and are arranged in two rows. Once loaded into the passageways, the termination sections of the two rows of terminals are exposed along opposite sides of the housing for termination. The termination sections are of the type known as insulation displacement (IDC), wherein a pair of parallel axially spaced plate sections traverse the conductor's path and defines a pair of slots between pairs of opposed beams; as the insulated wire is urged into the slots from beside the terminal, the beam edges cut through the insulation layer and engage and compress against the conductor to establish a pair of electrical connections between the terminal and the conductor. Insulative covers are utilized to simultaneously urge all the conductors of respective rows into their slots for termination while maintaining the appropriate spacing between the conductors, and thereafter become latched to the connector housing to protectively cover the terminations and maintain the conductors in the slots.

It is desired to provide an electrical connector with rows of closely spaced terminals enabling termination to respective conductors through insulation displacement along a common side of the connector housing.

It is also desired to provide such a connector where the terminals are molded in place in the housing.

SUMMARY OF THE INVENTION

The present invention is a method usable to provide a connector wherein the insulation displacement (IDC) termination sections of the terminals of a plurality of rows are exposed along a common side of the connector, for termination to respective conductors, where the terminals are molded into the housing; all conductors may thus be terminated by being urged into the IDC termination sections from a common side of the housing. The IDC termination sections of the two rows are staggered axially, so that the row farther from the side of the connector from which the conductors will be urged into the slots for termination, is positioned rearwardly from the IDC termination sections in the nearer row to provide a clearance for conductor termination. Additional rows could be provided with similar staggering. Within a row the IDC termination sections of adjacent terminals may be spaced axially to provide clearance from the next adjacent ones enabling close lateral spacing between terminals for greater density. Termination covers preferably are used to provide protective insulative covering of the terminations and to thereafter maintain the conductors in the slots.

Such connector is set forth in U.S. patent application Ser. No. 08/623,074 (Whitaker Case No. 16408) filed Mar. 28, 1996 (concurrently herewith) and assigned to the assignee hereof.

In the present invention, the terminals are molded in place within the connector housing in a manner exposing the IDC termination sections for eventual conductor termination, and also exposing the contact sections along the mating face, a manufacturing technique generally known. However, in the present invention, to assure that the terminals are retained precisely in position, core pins are utilized to engage the body sections of the terminals during molding for positional stability. So that the core pins extend from the same side of the mold, given that the terminal density is high, and the body sections of the terminals must be aligned between rows, the terminals of a certain row are formed to define lateral offsets enabling the core pins to pass by the terminals of that row to reach the terminals of another row positioned in vertical alignment therewith.

An embodiment of the present invention will now be disclosed by way of example with reference to the accompanying drawings.

DETAILED DESCRIPTION

Figure 1:
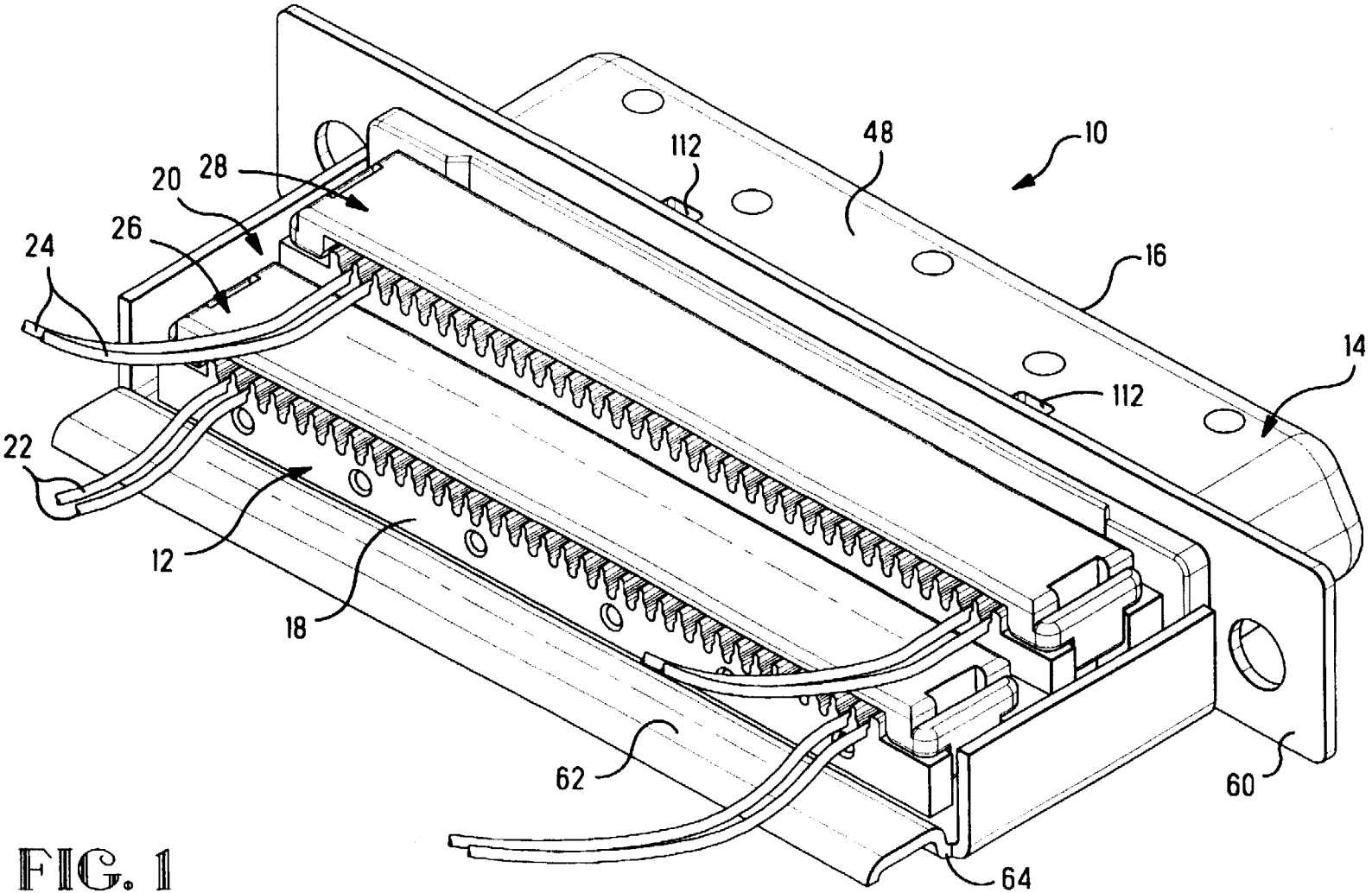
FIG. 1 is an isometric of a connector assembly of the present invention from rearwardly thereof with representative wires extending therefrom.

In FIG. 1 connector 10 is seen having an insulative housing 12 and a shell member 14 therearound, extending from a mating face 16 to a rear face 18, and having a termination face 20. A plurality of conductor wires 22 extends to a first or lower row of terminals along termination face 20, and a plurality of conductor wires 24 similarly extends to a second or upper row of terminals. First and second termination covers 26,28 are seen in FIG. 2 about to be utilized to cover the wires after being urged into the insulation displacement termination sections 32,34,36,38 at rearward ends of terminals 40,42 of the lower row and terminals 44,46 of 30 the upper row.

Figure 2:
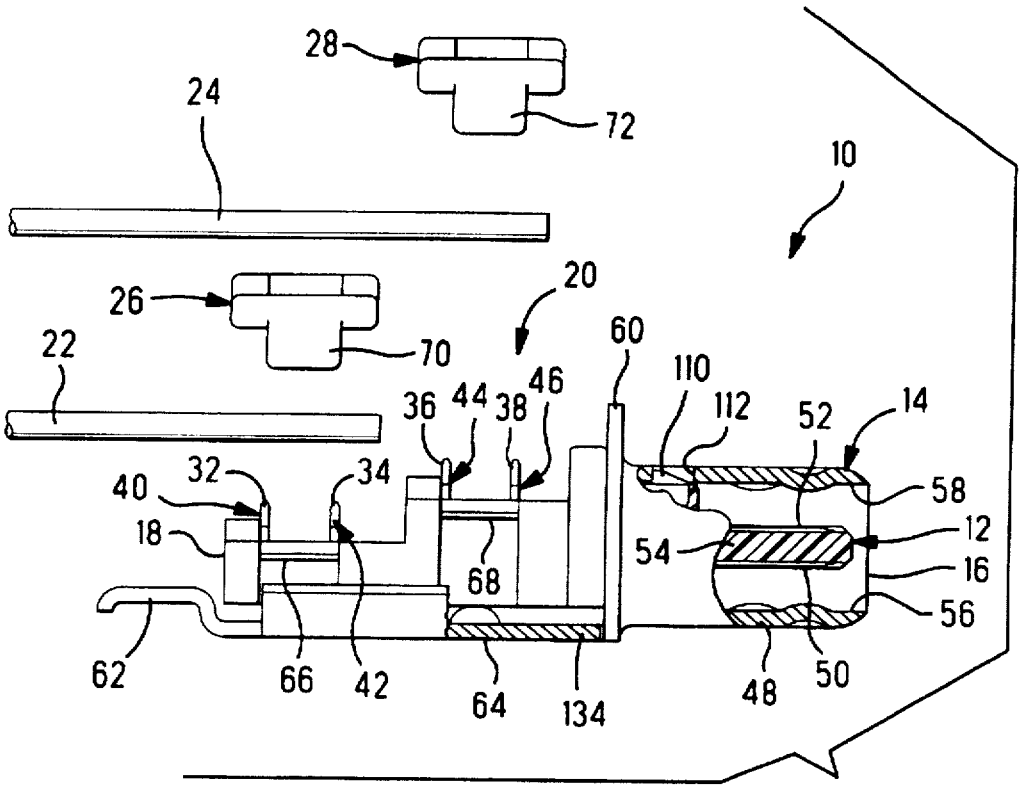
FIG. 2 is a side view of the connector of FIG. 1 prior to wire termination, with termination covers poised to be applied to the connector to terminate the wires to respective terminals, and with portions of the shell broken away to reveal detail of the housing.
Figure 9:
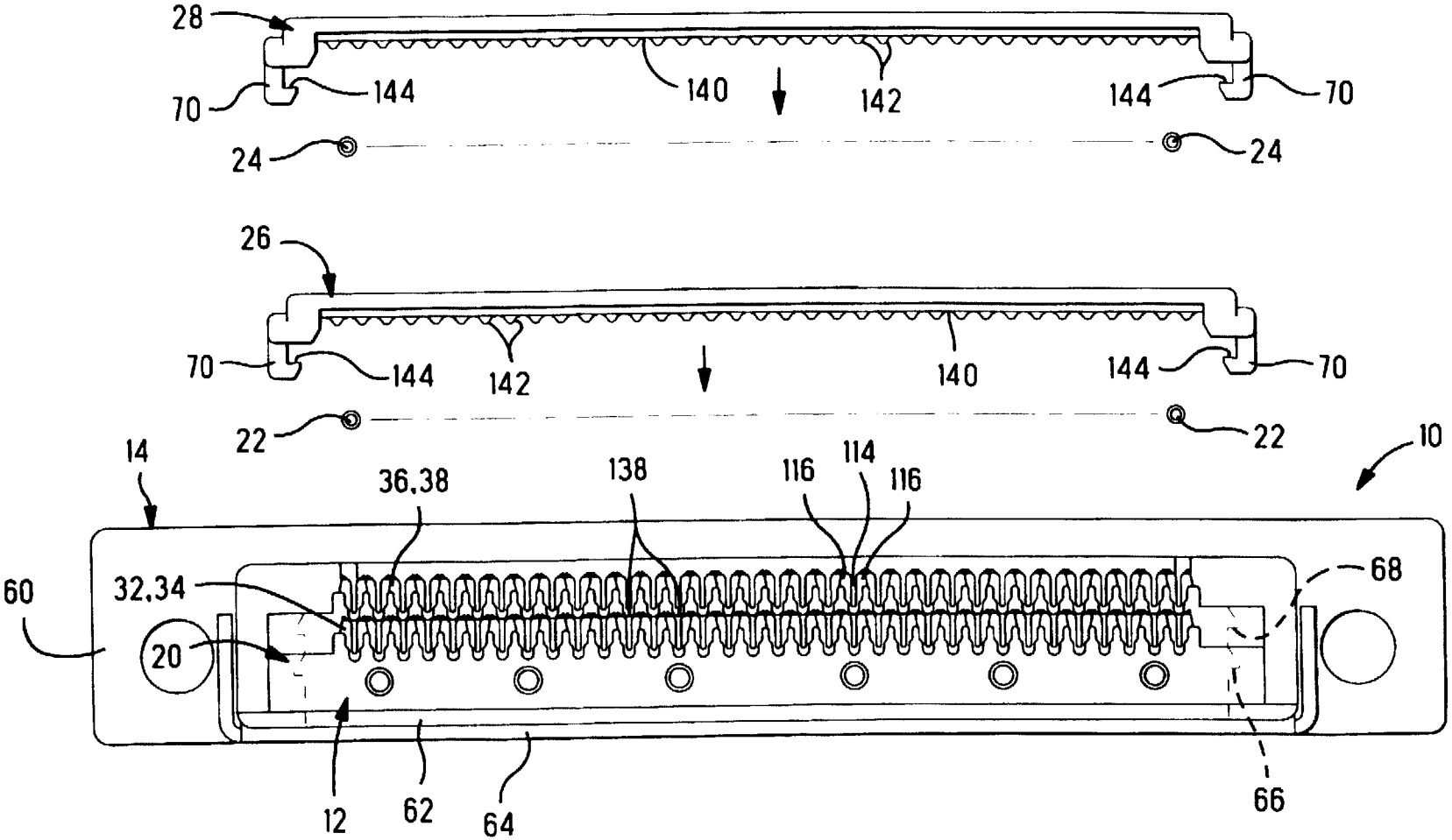
FIG. 9 is a plan view of the rear face of the connector of FIG. 8, with a termination cover poised for attachment to the connector.
Figure 10:
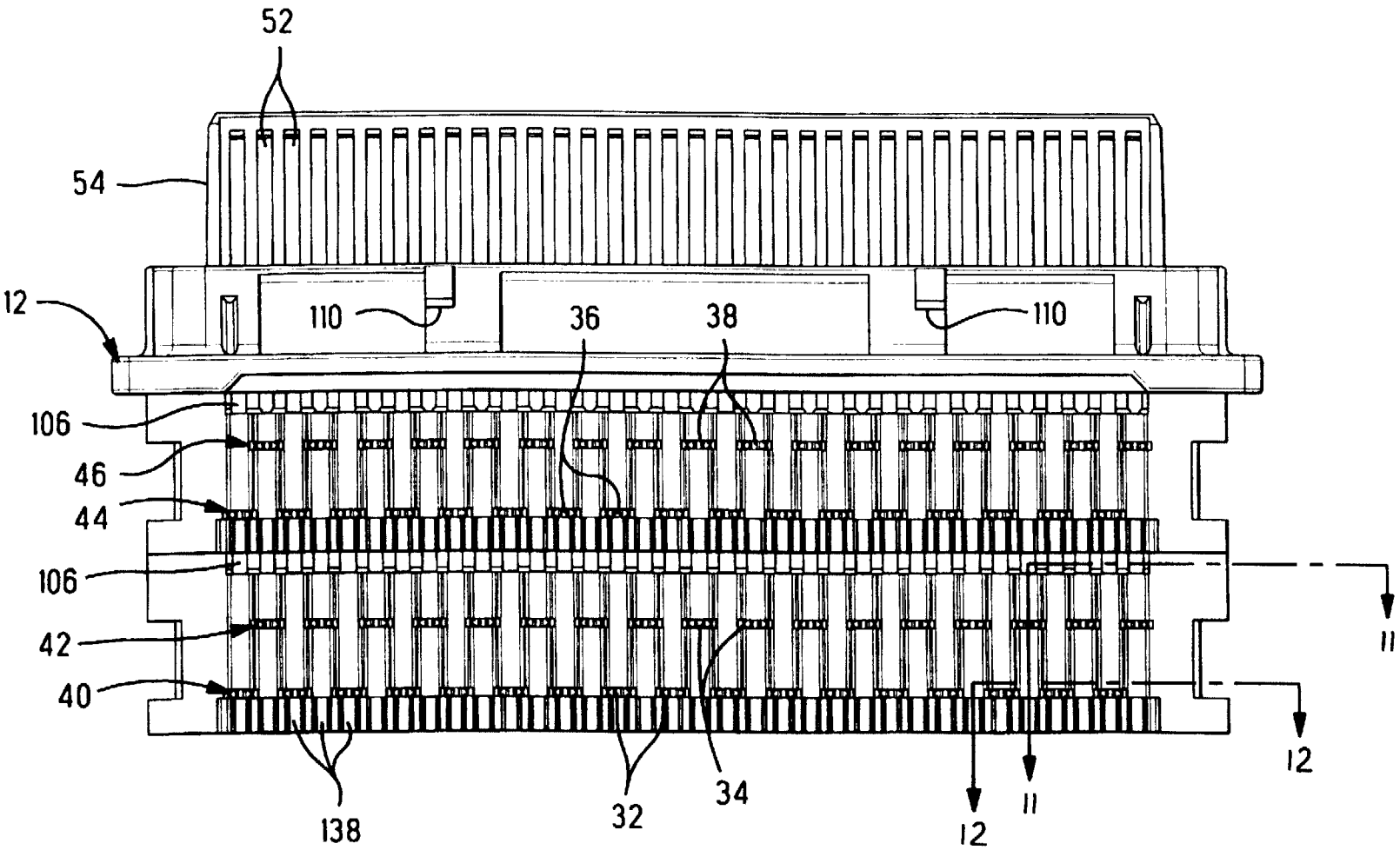
FIG. 10 is a plan view of the housing after insert molding.

FIG. 2 also shows the shell member 14 providing a shroud 48 surrounding the mating face 16, with front contact sections 50,52 of the lower and upper rows of terminals disposed along a support wall 54 of housing 12 and exposed within large cavities 56,58 for mating with corresponding contacts of a mating connector (not shown). Shell member 14 also is shown to include a flange 60 for holding fasteners such as jackscrews for securing a mating connector to connector 10, or for fastening of a backshell (not shown), or both, or for mounting to a panel. A cable tie support 62 extends rearwardly from a bottom wall 64 of shell member 14 around which a cable tie would be applied to secure the plurality of wires 22,24 to the connector for strain relief. Also seen are downwardly facing ledges 66,68 along the side of the housing 12 cooperating with inwardly directed latching projections (FIG. 9) of latch arms 70,72 of the termination covers 26,28 enabling latching of the termination covers to the housing.

Figure 3:
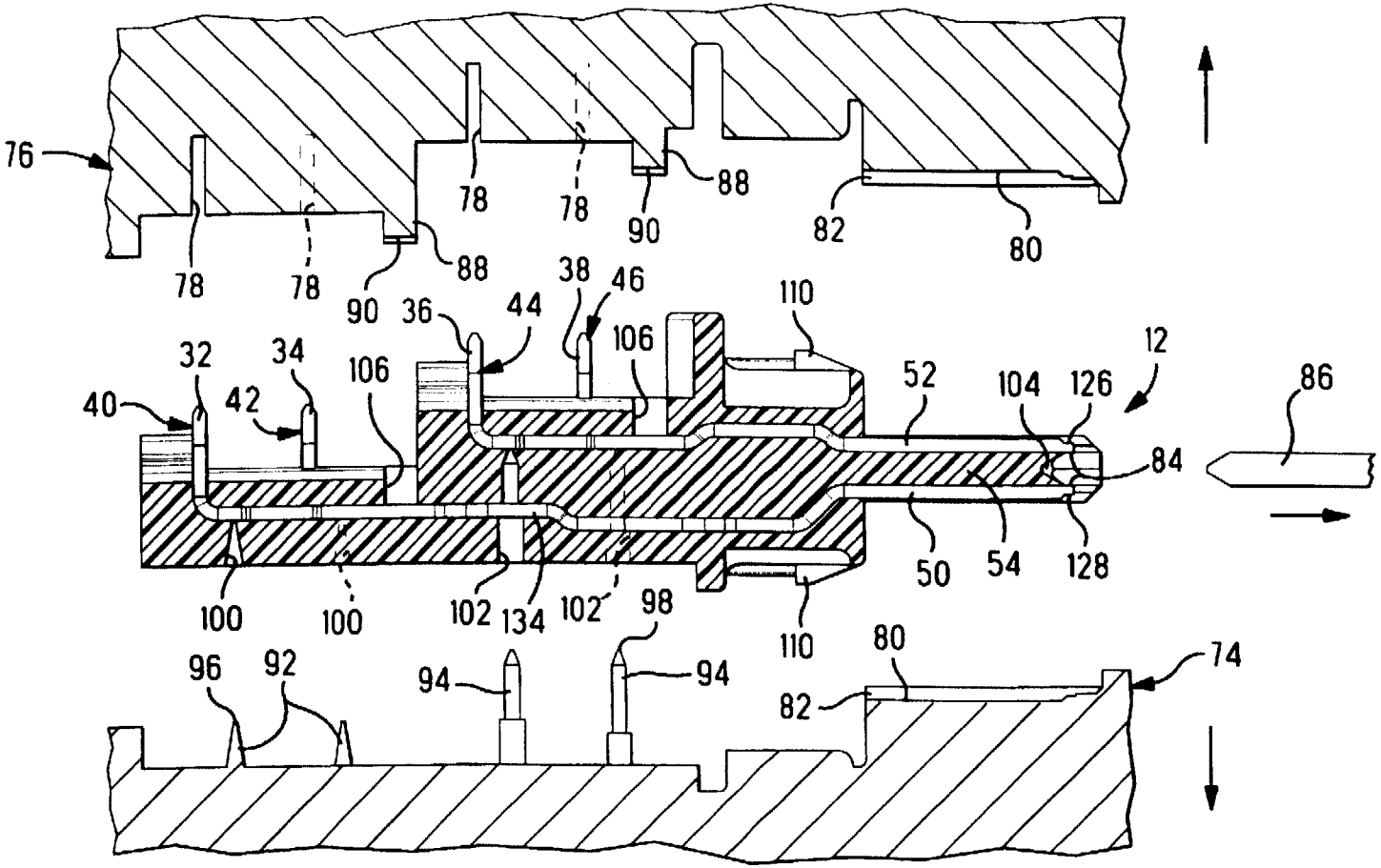
FIG. 3 is a longitudinal section view of the connector housing and terminals after the insert molding process, with upper and lower mold halves opening and core pins withdrawing from the molded housing.
Figure 4:
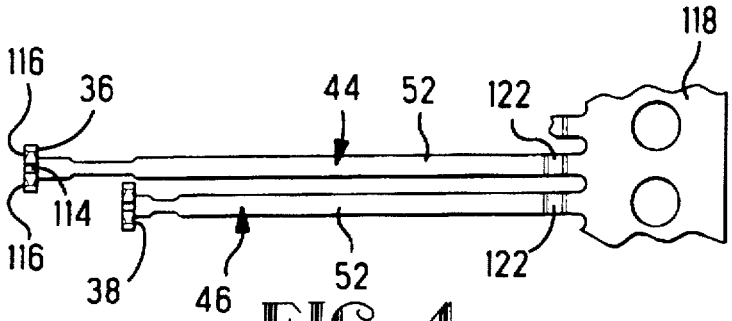
FIGS. 4 through 7 are plan and elevation views of the terminals of the upper and lower rows, respectively.
Figure 5:
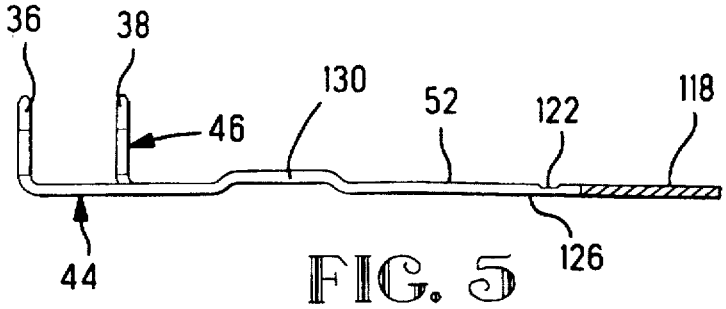
Figure 6:
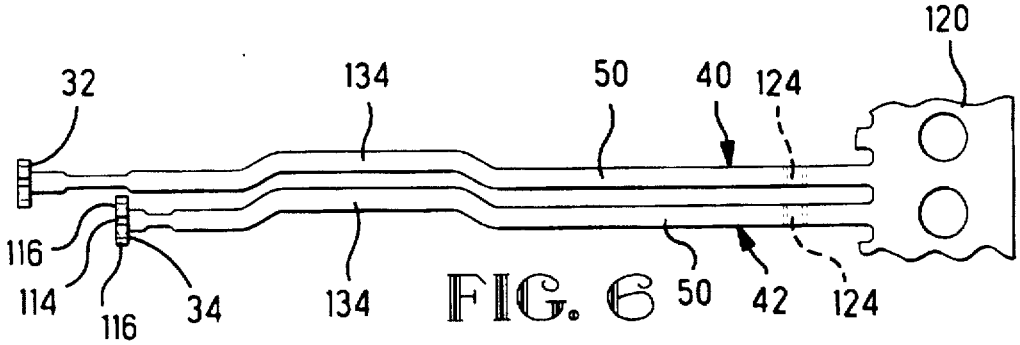
Figure 7:
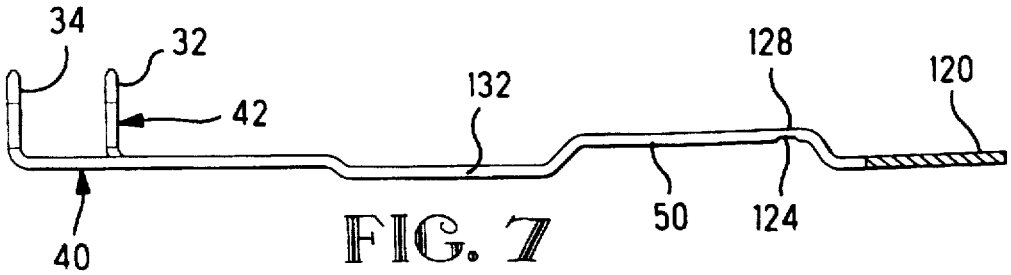
Figure 8:
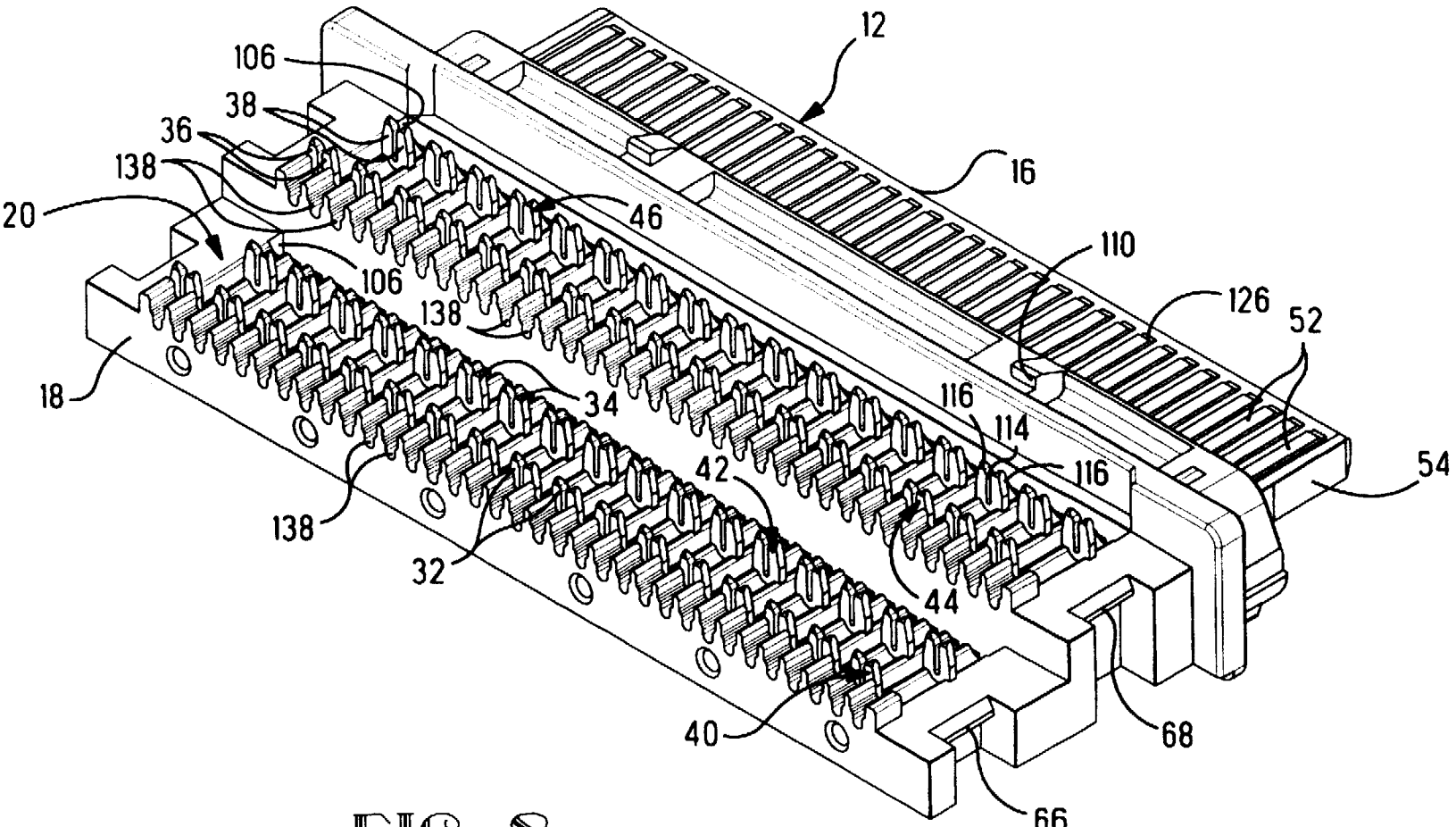
FIG.8 is an isometric view illustrating the connector housing and terminals of the assembly of FIG. 1 prior to wire termination.

In FIG. 3, molding of housing 12 is represented, with lower and upper mold halves 74,76 defining the mold cavity when together. In this insert molding procedure, terminals 40,42,44,46 are to be embedded within the insulative housing with only certain sections of the terminals exposed for electrical connection, namely, front contact sections 50,52 and IDC termination sections 32,34,36,38. It is imperative in the connector for the terminals to be securely held during the molding process precisely in predetermined positions, since the molding process involves the injection of molten plastic resin into the mold cavity under high pressure. The halves of the mold apparatus are seen to engage the terminals at their exposed contact sections and IDC termination sections, which generally is conventional in insert molding. IDC termination sections 32,34,36,38 are disposed in a close fit within slots 78 of the upper mold half, and front contact sections 50,52 are engaged therealong by surfaces 80 of the upper mold half within grooves 82, which is conventional in insert molding.

Additionally, the front ends 84 of the front contact sections are supported by core pins 86, as disclosed in U.S. patent application Ser. No. 08/453,128 filed May 24, 1995 and assigned to the assignee hereof, that in cooperation with mold surfaces 80 firmly grasp the front contact sections from opposed sides thereof. The upper and lower mold halves similarly support rearward portions of the terminals. Terminal support of the terminals is accomplished by ribs 88 of upper mold half 76 that abut upper surfaces of all terminals intermediate between the forward and rearward ends thereof, preferably ribs 88 are profiled to provide shallow grooves 90 within which the terminals are seated to prevent any lateral movement during molding. Lower mold half 74 includes arrays of core pins 92,94 that extend into the mold cavity for their tips 96,98 to support rearward ends of the terminals adjacent the IDC termination sections, and in cooperation with slots 78 and ribs 88 of upper mold half 76 firmly grasp the rearward ends of the terminals therebetween. Vestigial holes 100,102,104 and slots 106 remain in the housing after molding. Latch projections 110 are seen that latch into windows 112 of shell member 14 (FIGS. 1 and 2) upon assembly.

Figure 11:
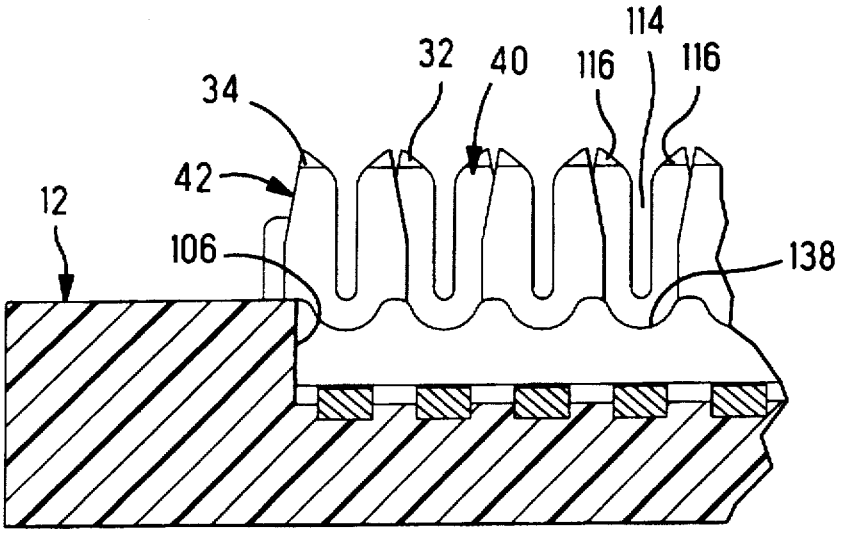
FIGS. 11 and 12 are partial cross-sectional views of the IDC termination sections of several terminals after insert molding of the housing, taken along lines 11—11 and 12—12 of FIG. 10.
Figure 12:
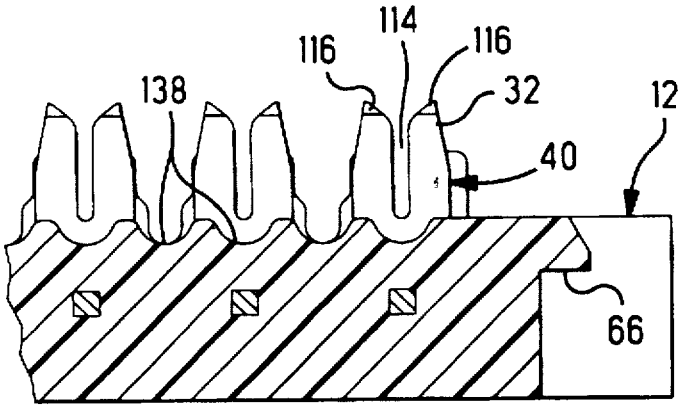

Terminals 40,42,44,46 are seen in FIGS. 5 to 8, illustrating first contact sections 50,52 and IDC termination sections 32,34,36,38 having IDC slots 114 between pairs of beams 116 (best seen in FIGS. 11 and 12) for later receipt of respective insulated wires to be urged thereinto. Terminals 40 and 42 of the lower row preferably are stamped and formed together on carrier strips 118,120 as are terminals 44 and 46 of the upper row, to maintain precise spacing and for convenience of handling during molding of housing 12. Preferably, carrier strips 118,120 are severed at notches 122,124 prior to insert molding, with the thin tips 126,128 of front contact sections 50,52 preferably defining a chamfered surface adjacent the top surface as a lead-in to facilitate mating with mating contacts during connector mating. The terminals of the two rows further are preferred to have vertical offsets 130,132 along intermediate portions diverging in opposing directions allowing a wide "window" between the upper and lower rows to facilitate the flow of molten resin laterally between the two rows of terminals.

Since it is desired that front contact sections 50 and 52 be vertically aligned, terminals 40 of the lower row are positioned directly beneath terminals 44 of the upper row, with terminals 42 and 46 being likewise positioned. In the present invention, lateral offsets 134 are formed in terminals 40 and 42 of the lower row permitting portions of core pins 94 to pass them to reach and engage terminals 44,46 directly above them for support thereof during the insert molding process. Further, core pins 94 include shoulders 136 supporting lower terminals 40,42 spaced forwardly from their IDC termination sections 32,34 that are supported by core pins 92, thus preventing intermediate portions of terminals 40,42 to bow during molding.

With reference now to FIGS. 8 to 12, molded housing 12 is seen to have a lower tier of IDC termination sections 32,34 for terminals 40,42 and an upper tier of IDC termination sections 36,38 for terminals 44,46. Channels 138 are defined for receipt of conductor wires therealong forwardly and rearwardly of the IDC termination sections. Termination covers 26,28 each include a wire face 140 having grooves 142 therealong within which the conductor wires are disposed when the covers are latched to housing 12, with latch arms 70,72 of termination covers 26,28 defining latching projections 144 that latch under ledges 66,68 of housing 12 recessed along both sides thereof. Termination may be performed in sequence with wires 22 first being urged into IDC termination sections of the lower tier, and then wires 24 into IDC sections of the upper tier; the covers may be placed with upper cover 28 being latched into position, followed by lower cover 26 being worked between the rows of upper wires 24 and lower wires 22 and then latched, especially if wires 22,24 are in twisted pairs extending from a common cable (not shown). Bottom wall 64 of shell member covers the vestigial holes 94,96, while the termination covers 26,28 effectively close off the slots 106 formed during molding.

Figure 13:
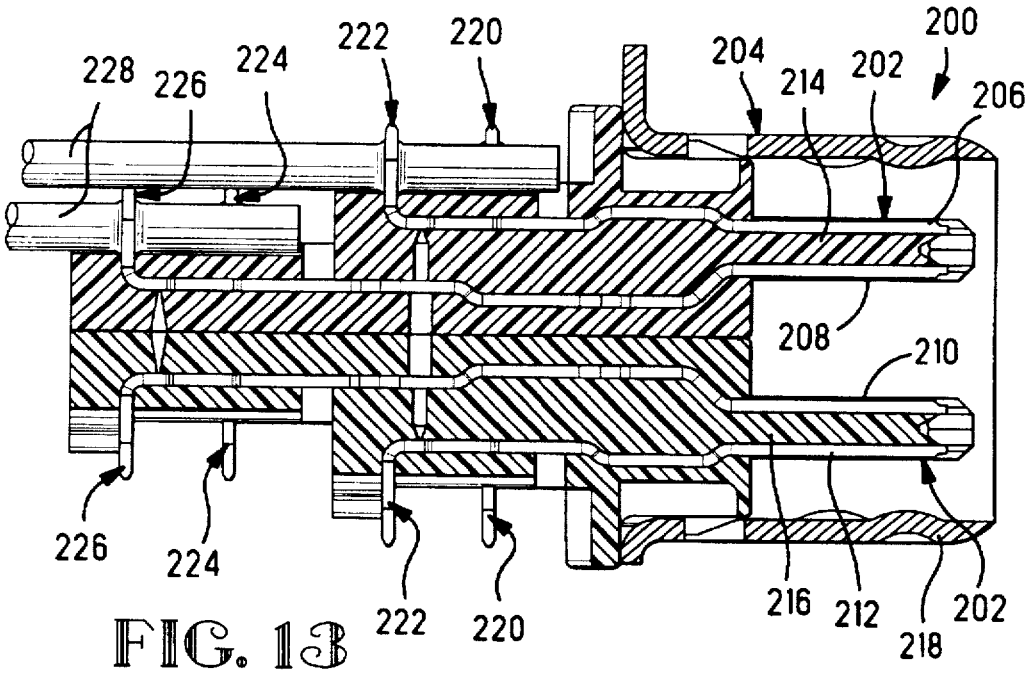
FIG. 13 is a longitudinal section view of another embodiment of the present invention, with two connectors containing the present invention secured within a common shell to define a four-row connector assembly.

An additional embodiment of the present invention is illustrated in FIG. 13. Four-row connector 200 includes a pair of housings 202 sandwiched together within a common shell member 204, presenting four rows of terminal front contact sections 206,208,210,212 along two housing blades 214,216 of the mating face disposed within shroud 218. Four tiers of IDC termination sections 220,222,224,226 are seen along the rearward end, with the IDC termination sections of each housing 202 facing opposed directions for termination to wires 228 as described above with respect to connector 12 of FIGS. 1 to 12.

The present invention provides for a connector having for example sixty-eight terminals presenting thirty-four front contact sections along each side of the forward housing section, the terminals of the two rows being vertically aligned with their centerlines spaced apart a distance of 0.8 mm. The centerlines of the conductor wires are similarly spaced apart a distance of 0.8 mm, and the IDC termination sections may each be about 0.97 mm wide, with the tiers being vertically staggered about 1.3 mm. The terminals have a thickness of about 0.25 mm, a width generally of about 0.44 mm, and lengths of between about 9.3 mm and 16.6 mm. In one example of the connector made in accordance with the present invention as shown in FIGS. 1 to 12, the total width of each housing is about 33.9 adjacent the mounting flange 60 of shell member 14; its height is about 5.2 mm adjacent the mounting flange; and its length is about 18.1 mm, all defining a very compact, high density connector having sixty-eight terminals in two rows of thirty-four each.

After wire termination, the connector assembly may have potting material disposed around the connector rearwardly from the mounting flange of the shell member, embedding the IDC termination sections, the wires and the termination covers for sealing thereof, if desired. Further, if desired a backshell may be affixed over the connector and an adjacent portion of the cable, rearwardly of the flange of the shell member.

Insert molding according to the present invention can be used, of course, where the terminals are not necessarily to be terminated to wires with insulation displacement, and can also be used for connectors having more than two rows of terminals.

Other modifications may be made to the specific examples described herein and that are within the spirit of the invention and the scope of the claims.

What is claimed is:

1. A method of making an electrical connector of the type having an insulative housing in which are disposed a plurality of terminals in at least two rows comprising the steps of:

providing a mold apparatus having first and second mold halves reciprocally movable together to define a mold cavity therebetween;

providing at least first and second rows of terminals each having body sections extending between front and rear contact sections, in which the front and rear contact sections of the terminals of said first row are aligned with those of the terminals of said second row;

providing first and second core pins on said first mold half extending into said mold cavity to engage and support said body sections of said terminals of said first and second rows from a first side of said mold cavity during molding, and providing portions of said second mold half to engage and support said terminals of said first and second rows from a second side of said mold cavity;

providing lateral offsets in said body sections of said first row of terminals so that said second core pins for supporting said second row of terminals pass thereby to reach and support said terminals of said second row; and molding said housing around said body sections of said first and second rows of terminals, whereafter said mold halves are separable thereby withdrawing said core pins from said terminals enabling said molded housing to be removed from said mold cavity.

2. The method as set forth in claim 1 wherein said second core pins include shoulders spaced from said second terminals for supporting adjacent ones of said first terminal body sections at said lateral offsets.

3. The method as set forth in claim 1 wherein said first and second core pins are tapered adjacent terminal-supporting ends thereof.

4. The method as set forth in claim 1 wherein said portions of said second mold half include first and second ribs extending transversely across said mold cavity to engage adjacent surfaces of said first and second terminal body sections, and said first and second ribs include axially aligned grooves wherein said body sections are seated for maintaining lateral positioning thereof during molding.

* * * * *